US006830359B2

(12) United States Patent
Fleury

(10) Patent No.: US 6,830,359 B2
(45) Date of Patent: Dec. 14, 2004

(54) ILLUMINATING OR INDICATING DEVICE

(75) Inventor: Benoist Fleury, Bobigny Cedex (FR)

(73) Assignee: Valeo Vision, Bobigny Cedex (FR)

( * ) Notice: Subject to any disclaimer, the term of this patent is extended or adjusted under 35 U.S.C. 154(b) by 0 days.

(21) Appl. No.: 10/167,814

(22) Filed: Jun. 12, 2002

(65) Prior Publication Data

US 2002/0191395 A1 Dec. 19, 2002

(30) Foreign Application Priority Data

Jun. 14, 2001 (FR) ..... 01 07998

(51) Int. Cl.[7] ..... F21V 13/04

(52) U.S. Cl. ..... 362/237; 362/241; 362/245; 359/389

(58) Field of Search ..... 362/236, 240, 362/214, 243, 245, 800, 247, 327, 341, 237, 241; 359/385, 389, 619, 852, 853, 387

(56) References Cited

U.S. PATENT DOCUMENTS

| | | | | | |
|---|---|---|---|---|---|
| 3,513,306 | A | * | 5/1970 | Le Vantine | 362/235 |
| 4,852,985 | A | * | 8/1989 | Fujihara et al. | 359/387 |
| 5,084,804 | A | | 1/1992 | Schairer | 362/61 |
| 5,309,277 | A | * | 5/1994 | Deck | 359/387 |
| 5,321,586 | A | | 6/1994 | Hege et al. | 362/32 |
| 5,345,333 | A | * | 9/1994 | Greenberg | 359/389 |
| 5,748,374 | A | * | 5/1998 | Neijzen et al. | 359/621 |
| 5,838,247 | A | * | 11/1998 | Bladowski | 340/815.45 |
| 6,024,473 | A | | 2/2000 | Fadel | |
| 6,075,648 | A | * | 6/2000 | Yamamoto et al. | 359/619 |

FOREIGN PATENT DOCUMENTS

| | | |
|---|---|---|
| CH | 304 170 | 12/1954 |
| EP | 0 158 330 | 10/1985 |
| EP | 0 949 449 | 10/1999 |
| EP | 1 008 801 | 6/2000 |
| FR | 2 052 038 | 4/1971 |
| FR | 2 760 067 | 8/1998 |
| FR | 2 760 068 | 8/1998 |
| WO | 9/48134 | 12/1997 |

OTHER PUBLICATIONS

French Search Report, Feb. 21, 2002.

* cited by examiner

*Primary Examiner*—Thomas M. Sember
*Assistant Examiner*—Hargobind S. Sawhney
(74) *Attorney, Agent, or Firm*—Morgan & Finnegan, LLP

(57) ABSTRACT

The present invention relates to an illuminating or indicating device, including at least two light sources, each light source being associated with a first optical system. According to the present invention, each first optical system, at finite distance, forms a real image of the light source, the images of the light sources being coincident at a common point constituting a secondary source, and a second optical system having an optical axis passing through the secondary source forms an illuminating or indicating beam from this secondary source.

14 Claims, 2 Drawing Sheets

ILLUMINATING OR INDICATING DEVICE

FIELD OF THE INVENTION

The present invention relates to the illuminating or indicating devices which are intended especially but not exclusively for motor vehicles.

BACKGROUND OF THE INVENTION

Such devices conventionally and schematically include a light source emitting light rays which are gathered by a reflector mirror which reflects them towards glazing for enclosing and protecting the illuminating or indicating device in order to form an illuminating or indicating light beam.

By juxtaposing several of these devices, it is thus possible conventionally to provide different light beams each complying with various sets of regulations, relating to their photometry and their spatial distribution.

The light sources used may consist of incandescent lamps, halogen lamps or discharge lamps, these various lamps possibly coexisting in a headlamp or a side lamp, each lamp being intended to fulfill a function, that is to say to form the light source at the origin of a beam possessing predetermined regulatory photometry and geometry.

It may be desirable to use several light sources in order to fulfill the same function, either in order to obtain a more intense beam by using several of the above-mentioned light sources, or to obtain a beam of intensity equal to that of a beam obtained with a single one of these light sources, but by using several, less powerful light sources.

The problem which the simultaneous use of several light sources in order to form a beam then poses lies in the fact that the individual contributions from each source have to add together exactly in order to form a resulting beam the photometry of which is in accordance with the regulations in force.

In order to form an overall light beam, for example, including a regulatory cut-off, such as a dipped light beam or a foglamp beam, it is necessary, on the one hand, for each individual light beam, that is to say each beam generated by a single light source, to feature such a cut-off, and, on the other hand, for all the individual cut-offs to superimpose exactly in order to constitute the cut-off of the overall light beam, which otherwise would be fuzzy, and thus not in accordance with the regulations.

A device is known, for example, from the document U.S. Pat. No. 5,084,804 including several light sources consisting of light-emitting diodes connected in series and each situated at the object focus of a parabolic reflector. Such a device can provide an indicating beam, but not an illuminating beam.

A device is also known from the document WO-97/48 134, including light-emitting diodes mounted on a common support, the diodes emitting light beams of complementary colours, for example amber and green/blue, in such a way that the superimposition of these beams produces a resultant beam of white colour. Coloured glazing can be arranged so as to confer a particular colour on the beam emerging from the device, which, here again, can provide an indicating beam, but not an illuminating beam.

An illuminating device is furthermore known from the document EP-A-0 158 330, including several identical aligned modules, each module comprising a light source and a reflector. A common glazing is arranged in front of all the modules, so as to provide for the spatial distribution of the beam resulting from the superimposition of the beams created by each module, in such a way as, for example, to obtain a main beam or a dipped beam. The individual modules can then be positioned with respect to one another and with respect to the glazing with extreme accuracy so as, for example, to obtain a dipped beam with sharp cut-off.

Finally, an illuminating device is known from the documents EP-A-0 949 449 and EP-A-1 008 801, including a single light source, arranged at the first focus common to several ellipsoidal portions arranged in a corolla. Each ellipsoid thus forms an image of this single source at its second focus, an optical system associated with each image forming a part of the overall resulting beam. Although using a single light source, the light rays originating from this source are shared into a certain number of individual beams, converging towards several secondary point sources, converging lenses forming, from these secondary point sources, different beams being superimposed so as to constitute a beam of predetermined photometry, for example a dipped beam, if appropriate screens are arranged at the secondary point sources. Under these conditions, the light sources, the reflectors, the screens and the lenses have to have precisely determined relative positions, which results in great complexity of assembly of this illuminating device, high cost and a lack of reliability due to the vibration to which it is subjected during its use on a vehicle.

The present invention lies in this context, and its purpose is to propose an illuminating or indicating device using several light sources in order to form a light beam in accordance with a predetermined set of regulations, the assembly of the sources and their positioning with respect to the other elements of the illuminating or indicating device cooperating to form this light beam being carried out in a simple and reliable way, the illuminating or indicating device thus designed being inexpensive.

Hence the object of the present invention is an illuminating or indicating device, including at least two light sources, each light source being associated with a first optical system.

SUMMARY OF THE INVENTION

According to the present invention, each first optical system, at finite distance, forms a real image of the light source, the images of the light sources being coincident at a common point constituting a secondary source, and a second optical system having an optical axis passing through the secondary source forms an illuminating or indicating beam from this secondary source.

According to other advantageous and non-limiting characteristics of the invention:

- the first optical systems consist of converging lenses forming light sources from the coincident real images so as to form the secondary source;
- the first optical systems consist of ellipsoids each having an object focus coincident with the light sources, the image foci of the ellipsoids all being coincident in order to form the secondary source;
- the second optical system consists of a converging lens, the object focus of which is coincident with the secondary source and forming the illuminating or indicating beam;
- the second optical system consists of a reflecting surface, possessing an object focus coincident with the secondary source and forming the illuminating or indicating beam;

the reflecting surface is convex;

the convex reflecting surface is a portion of a paraboloid;

deflecting glazing is arranged downstream of the second optical system in order to confer on the light beam emerging from the device a predetermined spatial distribution;

the convex reflecting surface includes at least one region able by itself to generate an illuminating or indicating beam with cut-off;

a screen is arranged perpendicularly to the optical axis of the second optical system;

the screen is movable between two positions, a first position in which it intercepts part of the light rays constituting the secondary source and a second position in which it lets through all the light rays originating from the secondary source;

the light sources are light-emitting diodes;

the light sources consist of the extremities of optical fibres or of light guides;

the light sources are lit up selectively.

Other objects, characteristics and advantages of the present invention will emerge clearly from the description which will now be given of an embodiment example given in a non-limiting way by reference to the attached drawings in which

In the various figures, elements which are identical or play the same purpose are allotted the same reference marks.

DESCRIPTION OF THE PREFERRED EMBODIMENTS

Figure 1:
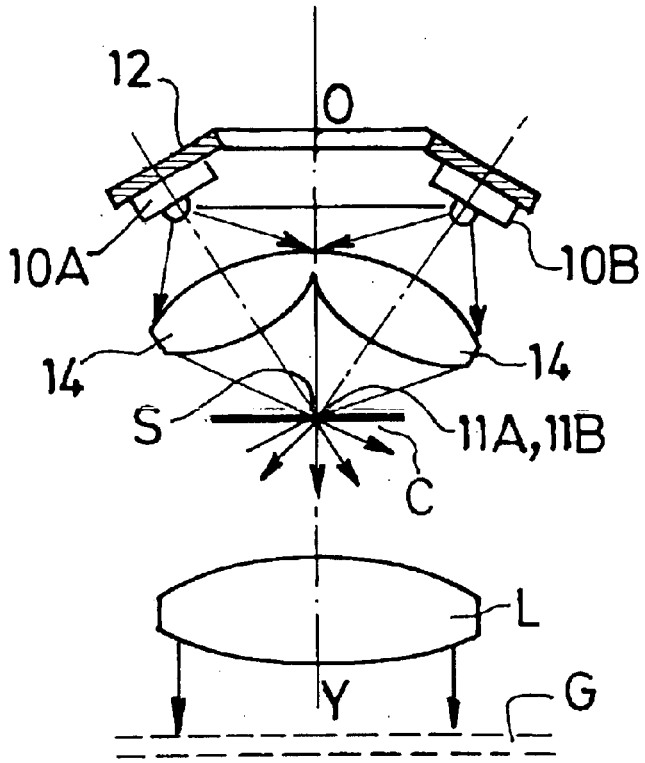
FIG. 1 represents a diagrammatic view in section of a first embodiment of the present invention.

In FIG. 1 has been represented a view in diagrammatic section of a first embodiment of the present invention. In this figure are seen light sources 10A and 10B, arranged on a frustoconical crown 12 with axis of revolution Oy. Only two sources have been represented for clarity of the drawing, but it is quite obvious that the present invention applies to any number, greater than or equal to two, of light sources, regularly distributed on the crown 12 about the axis Oy.

Converging lenses 14 are arranged at a distance from the light sources 10A, 10B, . . . , in such a way as to gather the light rays emitted by them and to form real images 11A, 11B, . . . of them. The lenses 14 are preferably all identical, and they can be carried by a common support.

In accordance with the present invention, the images 11A, 11B, . . . , are coincident at a common point S, such that all the rays emitted by the sources 10A, 10B, . . . , and having passed through the lenses 14, are all converging at this common point S. The common point S thus constitutes a secondary source of light rays resulting from the superimposition of the images 11A, 11B, . . . of the sources 10A, 10B . . .

The secondary source S can then serve as a main source in order to give rise to an illuminating or indicating beam. It is then possible to arrange, at a distance from the common point S, a converging lens L, in such a way that its object focus is also coincident with the common point S. The optical axis of the lens L is advantageously coincident with the axis Oy. The lens L thus forms an image at infinity of the common point S, which also provides an illuminating or indicating beam, which can easily be made to conform to a predetermined set of regulations by choosing sources 10A, 10B, . . . , of intensity appropriate to the desired illuminating or indicating function.

The present invention makes it possible, for example, in a particularly simple way, to obtain a light beam with a sharp cut-off, despite the use of several light sources. This is because the lens L forms a beam of rays which are parallel or substantially parallel. It is then possible to arrange downstream (in the direction of progression of the light rays) of the lens L glazing G, represented in dashed lines in FIG. 1, equipped with striations or with deflecting elements such as Fresnel prisms, in order, in a known way, to obtain the desired spatial distribution for the rays emerging from the glazing G.

In place of using deflecting glazing G, it is advantageously possible to make provision to arrange a screen C in the immediate vicinity of the common point S, perpendicularly to the optical axis Oy of the lens L, in order to intercept the light rays directed towards the lens L and which would emerge from it situated on the unwanted side of this cut-off.

The screen C thus possesses an edge, situated in the immediate vicinity of the common point S, and thus in the focal plane of the lens L. The lens L therefore forms, at infinity, the image of the edge of the screen C, which constitutes the cut-off of the light beam emitted by the lens L. It would advantageously be possible to provide for the screen to be made movable, for example movable in rotation about an axis perpendicular to the optical axis Oy, between two positions, a first position in which it intercepts part of the light rays constituting the secondary source in order to obtain a beam with cut-off such as a dipped beam, and a second position in which it lets through all the light rays originating from the secondary source, in order to obtain a beam without cut-off, such as a main beam.

It would then be possible, in this case, to use glazing G which is smooth or slightly deflecting, since it no longer has any function of spatial distribution of the light beam.

Figure 2:
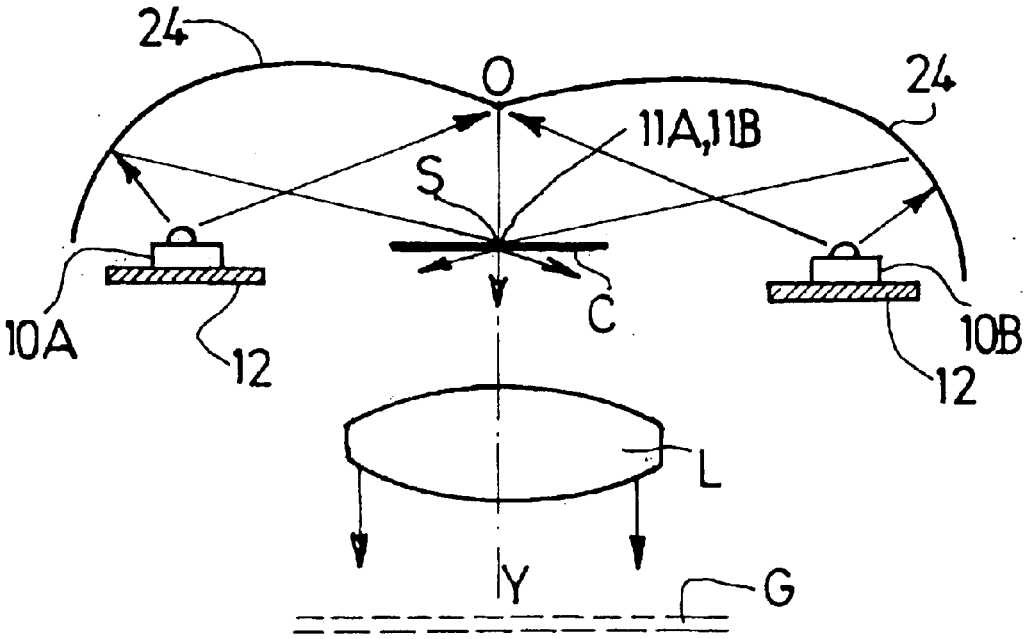
FIG. 2 represents a diagrammatic view in section of a variant of the first embodiment of the present invention.

In FIG. 2 has been represented a view in diagrammatic section of a variant of the first embodiment of the present invention which has just been described. In this figure are seen light sources 10A and 10B, arranged on a crown 12, which, in this variant, may be a flat or frustoconical ring, with axis of revolution Oy. Only two sources have been represented for clarity of the drawing, but it is quite obvious that the present invention applies to any number, greater than or equal to two, of light sources, regularly distributed on the crown or the ring 12 about the axis Oy.

According to this variant, the optical systems forming real images of the light sources 10A, 10B, . . . , are portions of ellipsoids 24, arranged in a corolla about the axis Oy, in such a way that their first foci coincide with, the sources 10A, 10B, . . . , and that their second foci are coincident with each other on the axis Oy and with the object focus of the lens L.

In the present description, the term "ellipsoid" should be understood as designating an overall surface is [sic] close to that of an axisymmetric ellipsoid, that is to say a surface the section of which through a plane passing through the two foci is a portion of an ellipse or is nearly a portion of an ellipse, but the eccentricity of which may vary from one sectional plane to another, the surface possibly comprising areas of limited extent the cross-section of which departs from that of a portion of an ellipse.

In the same way as before, the light rays originating from the various sources 10A, 10B, . . . , are all convergent towards the common point S, which again constitutes a secondary source of light rays resulting from the superimposition of the images 11A, 11B, . . . , of the sources 10A, 10B, . . . The secondary source S serves as a main source in order to give rise, by way of the lens L the object focus of which coincides with the secondary source S, to an illuminating or indicating beam, which can easily be made to conform to a predetermined set of regulations by choosing sources 10A, 10B, . . . , of intensity appropriate to the desired illuminating or indicating function.

As in the embodiment represented in FIG. 1, it is easily possible to obtain a beam of desired spatial distribution, for example a cut-off beam, by using deflecting glazing G, or a screen C, possibly movable between two positions.

Figure 3:
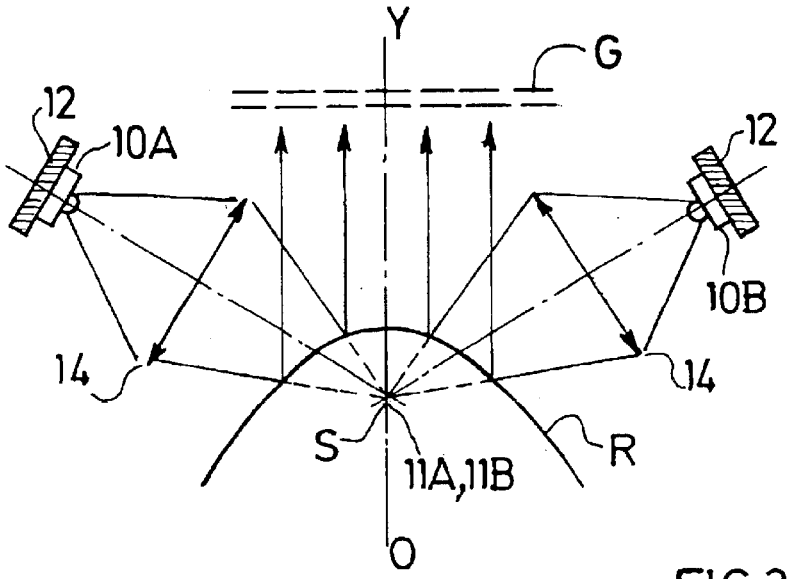
FIG. 3 represents a diagrammatic view in section of a second embodiment of the present invention.

In FIG. 3 has been represented a view in diagrammatic section of a second embodiment of the present invention. It is seen in this figure that the light sources 10A and 10B are still arranged on a frustoconical crown 12 with axis of revolution Oy. As in the first embodiment, only two sources have been represented for clarity of the drawing, but the present invention applies to any number, greater than or equal to two, of light sources, regularly distributed on the crown 12 about the axis Oy.

As in the first embodiment, converging lenses 14 are arranged at a distance from the light sources 10A, 10B, . . . , in such a way as to form real images 11A, 11B, . . . thereof. The images 11A, 11B, . . . , are here again coincident at a common point S, such that all the rays emitted by the sources 10A, 10B, . . . , and having passed through the lenses 14, are all convergent at this common point S, which then constitutes the secondary source S of light rays resulting from the superimposition of the images 11A, 11B, . . . of the sources 10A, 10B, . . . and which can then serve as a main source in order to give rise to an illuminating or indicating beam.

In this embodiment, the optical system used to form the illuminating or indicating beam from the source S consists of a reflecting surface R. The reflecting surface R may consist of a conventional reflector of an illuminating headlamp or of an indicator lamp, that is to say a concave surface, the secondary source S playing the role of a conventional lamp.

However, for reasons of bulk, it is advantageous to use a convex reflecting surface, as has been represented in FIG. 3. The reflecting surface R can then be regarded as the surface of a paraboloid of revolution. This paraboloid of revolution is arranged in such a way that its optical axis is coincident with the axis Oy of symmetry with respect to which the light sources 10A, 10B, . . . , are arranged, and that its focus is coincident with the secondary source S.

The reflecting surface R being convex, it converts the secondary source S, formed of real images of the light sources 10A, 10B, . . . , into a virtual object, the reflecting surface R of which gives a real image, situated at infinity in the case of a paraboloid of revolution, which thus provides an illuminating or indicating beam, which can easily be made to conform to a predetermined set of regulations by choosing sources 10A, 10B, . . . , of intensity appropriate to the desired illuminating or indicating function.

According to this embodiment, it is also possible, in a particularly simple way, to obtain a light beam with a sharp cut-off, despite the use of several light sources. This is because it is sufficient to arrange deflecting glazing G, on the path of the beam downstream of the reflecting surface R, in order to obtain the desired spatial distribution for the light rays.

Instead of arranging deflecting glazing G, it would advantageously be possible to choose to shape the reflecting surface R so that it is able by itself to reflect an illuminating or indicating beam with cutoff. It could, for example, be produced taking account of the teachings of the documents FR-A-2 760 067 and FR-A-2 760 068, both in the name of the Applicant. Thus a reflecting surface R of convex shape will be used, complementary to the concave shape described in these documents.

It would then be possible, in this case, to use glazing G which is smooth or slightly deflecting since it no longer has any function of spatial distribution of the light beam.

Figure 4:
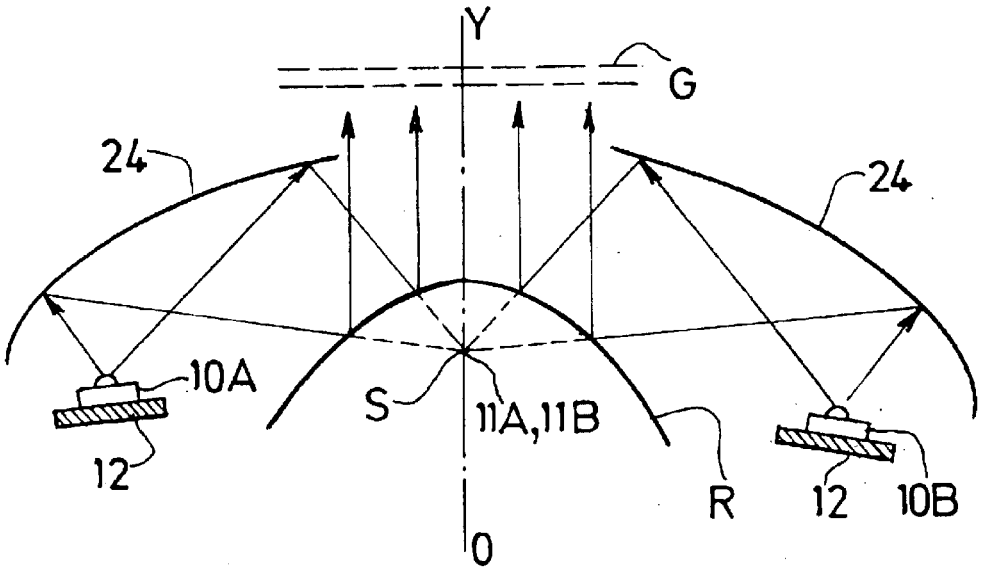
FIG. 4 represents a diagrammatic view in section of a variant of the second embodiment of the present invention.

In FIG. 4 has been represented a view in diagrammatic section of a variant of the second embodiment which has just been described. In this figure are seen light sources 10A and 10B, arranged on a crown 12, which can also be a flat or frustoconical ring, with axis of revolution Oy. Only two sources have been represented for clarity of the drawing, the invention applying, however, to any number, greater than or equal to two, of light sources, regularly distributed on the crown or the ring 12 about the axis Oy.

As in the variant of the first embodiment, the optical systems forming real images of the light sources 10A, 10B, . . . , are portions of ellipsoids 24, arranged in a corolla about the axis Oy, in such a way that their first foci coincide with the sources 10A, 10B, . . . , and that their second foci are coincident with each other on the axis Oy and with the object focus of the reflecting surface R.

In the same way as before, the light rays originating from the various sources 10A, 10B, . . . , are all convergent towards the common point S, which again constitutes a secondary source of light rays resulting from the superimposition of the images 11A, 11B, . . . , of the sources 10A, 10B, . . .

The secondary source S serves as a main source in order to give rise, by way of the reflecting surface R, the object focus of which coincides with the secondary surface S, to an illuminating or indicating beam, which can easily be made to conform to a predetermined set of regulations by choosing sources 10A, 10B, . . . , of intensity appropriate to the desired illuminating or indicating function.

As in the embodiment represented in FIG. 3, it is easily possible to obtain a beam of desired spatial distribution, for example a cut-off beam, by using deflecting glazing G, or a convex reflecting surface R produced in accordance with the teachings of the above-mentioned documents FR-A-2 760 067 and FR-A-2 760 068.

In the second embodiment represented in FIG. 3, or its variant represented in FIG. 4, it will be noted, moreover, that it is very easily possible to identify, in the beam emerging from the device, the light rays which originate from a predetermined light source and having been reflected by a predetermined region of the reflecting surface R. Thus, in the case of the use of only two light sources for simplification, the light rays emitted by the source 10A are all comprised in the left-hand half of the beam of FIGS. 3 and 4, whereas the light rays emitted by the source 10B are all comprised in the right-hand half of the light beam represented in these figures.

It is thus possible to allocate certain light sources and/or certain regions of the reflecting surface R to particular beam geometries, to particular light intensities, or even to particular colours. It would thus be possible to provide:

for certain light sources to emit a particular colour, for example red or amber, in order to provide an indicating function in the beam, for certain regions of the reflecting surface R associated with predetermined sources to be parabolic, in order to provide, for example, in the beam, a main-beam illuminating function, and/or for certain regions of the reflecting surface R associated with predetermined sources to conform to the teaching of the above-mentioned documents FR-A-2 760 067 and FR-A-2 760 068, in order to provide a dipped-beam illuminating function in the beam, for example.

According to such a design, the light sources 10A, 10B, . . . , are lit selectively, progressively or in "all or nothing" mode, depending on the illuminating or indicating function which it is desired to see present in the final beam.

Such a possibility is also open for the first embodiment represented in FIG. 1. In point of fact, it is sufficient to shift a light source, for example the sources 10B, and/or the lens 14 which is associated with it, and/or to alter the focal length of the lens 14, in order to modify its contribution to the final beam. Likewise, in the case of FIG. 2, it is sufficient to shift a light source, for example the source 10B, and/or the ellipsoidal portion 24 which is associated with it, and/or to alter the focal length or the eccentricity of the ellipsoidal portion 24, to modify the contribution of the source 10B in the final beam.

According to this design, it is then sufficient selectively to light up the light sources 10A, 10B, . . . , selectively or in "all or nothing" mode, in order to modulate their contribution to the final beam.

According to the present invention, an illuminating or indicating device using several light sources to form a light beam in accordance with a predetermined set of regulations has thus actually been produced. With this beam being defined by a single system, namely the second optical system consisting of the converging lens or of the reflecting surface, its spatial characteristics are obtained very simply. Moreover, and above all with the second embodiment, an illuminating or indicating device is obtained which is particularly compact in its dimension parallel to the optical axis, that is to say of shallow depth. The assembling of the sources and their positioning with respect to the other elements of the illuminating or indicating device contributing to form this light beam can be carried out simply and reliably, the sources being fixed onto a support including a part shaped as a frustoconical crown or a flat ring, a part serving as a support for the first optical systems forming real images of these light sources, and a part serving as support for the second optical system forming an illuminating or indicating beam from these coincident real images. An illuminating or indicating device thus designed is inexpensive to construct, to assemble and to maintain.

Needless to say, the present invention is not limited to the embodiments which have been described, but the person skilled in the art, on the contrary, could apply numerous modifications to it which fall within its scope. Hence, for example, the light sources used may be incandescent lamps, halogen lamps, discharge lamps, light-emitting diodes, or even the extremities of optical fibres or of light guides, the light sources used to constitute a single illuminating or signalling device according to the present invention possibly being of different types, for example in the second embodiment, it would be possible to use a discharge lamp to produce a dipped beam and a halogen lamp to produce a main beam.

What is claimed is:

1. An illuminating or indicating device, comprising:

at least two light sources, and at least two first optical systems, wherein a first of said at least two light sources being optically coupled with one of said at least two first optical systems, and a second of said at least two light sources being optically coupled with the other of said at least two first optical systems, wherein each of said at least two first optical systems, at a finite distance, forms a real image of optically coupled one of said at least two light sources, the images of the optically coupled one of said at least two light sources being coincident at a common point constituting a secondary source, and wherein a second optical system having an optical axis passing through the secondary source forms an illuminating or indicating beam from the secondary source.

2. The device according to claim 1, wherein each of said at least two first optical systems consists of a converging lens forming said real image of the respectively coupled one of said at least two light sources, said real images of all of said at least two light sources being coincident so as to form the secondary source.

3. The device according to claim 1, wherein each of said at least two first optical systems consist of ellipsoids each having an object focus coincident with said light sources, the image foci of the ellipsoids all being coincident in order to form the secondary source.

4. The device according to claim 1, wherein the second optical system consists of a converging lens possessing an object focus coincident with the secondary source and forming the illuminating or indicating beam.

5. The device according to claim 1, wherein the second optical system consists of a reflecting surface possessing an object focus coincident with the secondary source and forming the illuminating or indicating beam.

6. The device according to claim 5, wherein the reflecting surface is convex.

7. The device according to claim 6, wherein the convex reflecting surface is a portion of a paraboloid.

8. The device according to claim 6, wherein the convex reflecting surface includes at least one region able by itself to reflect an illuminating or indicating beam with a cut-off.

9. The device according to claim 8, wherein the screen is movable between two positions, a first position in which the screen intercepts part of the light rays constituting the secondary source and a second position in which the screen lets through all the light rays originating from the secondary source.

10. The device according to claim 1, wherein a deflecting glazing is arranged downstream of the second optical system in order to confer on the light beam emerging from the device a predetermined spatial distribution.

11. The device according to claim 1, wherein a screen is arranged perpendicularly to the optical axis of the second optical system.

12. The device according to claim 1, wherein said at least two light sources are light-emitting diodes.

13. The device according to claim 1, wherein said at least two light sources consist of the extremities of optical fibers or of light guides.

14. The device according to claim 1, wherein said at least two light sources are lit up selectively.

* * * * *